US005564546A

United States Patent [19]

Molbak et al.

[11] Patent Number: 5,564,546

[45] Date of Patent: Oct. 15, 1996

[54] COIN COUNTER/SORTER AND COUPON/VOUCHER DISPENSING MACHINE AND METHOD

[75] Inventors: Jens H. Molbak, Portola Valley; Vae E. Sun, Palo Alto, both of Calif.

[73] Assignee: Coinstar, Inc., Bellevue, Wash.

[21] Appl. No.: 255,539

[22] Filed: Jun. 6, 1994

Related U.S. Application Data

[63] Continuation of Ser. No. 940,931, Sep. 4, 1992, abandoned.

[51] Int. Cl.[6] ..... G07F 17/42

[52] U.S. Cl. ..... 194/216; 194/347

[58] Field of Search ..... 194/346, 347, 194/348, 216; 186/52; 453/3, 8, 17; 235/381, 383

[56] References Cited

U.S. PATENT DOCUMENTS

| | | | |
|---|---|---|---|
| 466,303 | 2/1891 | Thompson . | |
| 2,865,561 | 12/1958 | Rosapepe | 232/7 |
| 3,065,467 | 11/1962 | Prevost . | |
| 3,132,654 | 5/1964 | Adams . | |
| 3,173,742 | 3/1965 | Simjian . | |
| 4,059,122 | 11/1977 | Kinoshita | 453/3 |
| 4,249,552 | 2/1981 | Margolin et al. | 194/207 |
| 4,266,121 | 5/1981 | Hirose | 235/381 |
| 4,360,034 | 11/1982 | Davila et al. . | |
| 4,380,316 | 4/1983 | Glinka et al. | 232/16 |
| 4,383,540 | 5/1983 | DeMeyer et al. | 453/3 |
| 4,434,359 | 2/1984 | Watanabe | 235/379 |
| 4,558,711 | 12/1985 | Yoshiaki et al. . | |
| 4,598,378 | 7/1986 | Giacomo | 364/479 |
| 4,611,205 | 9/1986 | Eglise | 194/217 X |
| 4,622,456 | 11/1986 | Naruto et al. . | |
| 4,706,577 | 11/1987 | Jones . | |
| 4,716,799 | 1/1988 | Hartmann . | |
| 4,723,212 | 2/1988 | Mindrum et al. | 235/385 |
| 4,753,625 | 6/1988 | Okada | 453/32 |
| 4,883,158 | 11/1989 | Kobayashi et al. | 194/217 |
| 4,910,672 | 3/1990 | Off et al. | 235/383 X |
| 4,921,463 | 5/1990 | Primdahl et al. | 453/3 |
| 4,953,086 | 8/1990 | Fukatsu | 235/379 X |
| 4,995,848 | 2/1991 | Goh | 453/3 |
| 5,021,967 | 6/1991 | Smith | 235/379 X |
| 5,025,139 | 6/1991 | Halliburton, Jr. | 235/379 |
| 5,039,848 | 8/1991 | Stoken | 194/217 X |
| 5,083,765 | 1/1992 | Kringel | 271/118 |
| 5,091,713 | 2/1992 | Horne et al. | 340/541 |
| 5,173,851 | 12/1992 | Off et al. | 364/401 |
| 5,321,242 | 6/1994 | Heath, Jr. | 235/382 |

FOREIGN PATENT DOCUMENTS

| | | | |
|---|---|---|---|
| 2060630 | 8/1992 | Canada | G06F 15/24 |
| 2067987 | 11/1992 | Canada | G06F 15/21 |
| 3-92994 | 4/1991 | Japan | 194/347 |
| 93/07846 | 4/1994 | WIPO | G06F 15/16 |

OTHER PUBLICATIONS

*Turning Cans Into Cold Cash,* The Washington Post, Jul. 2, 1991, pp. D1 and D4, 194–209.

*Primary Examiner*—F. J. Bartuska
*Attorney, Agent, or Firm*—Bogle & Gates P.L.L.C.

[57] ABSTRACT

A coin sorting and counting machine and a method for operating it to automatically dispense cash vouchers based on the value of the counted coins, manufacturers' coupons and store coupons. Coins are placed in a hopper tray. When the hinged tray is lifted, the coins travel through a waste management system and into the coin sorting and counting apparatus. The value of the coins and the number of coins within each denomination are displayed as the coins are counted. After sorting, the coins fall into a temporary holding area. At this point the transaction can either be canceled or accepted. If the transaction is canceled, the coins are returned. If the transaction is accepted, the coins fall into a storage area and the user is issued a cash voucher and a series of store coupons. Manufacturers' coupons are dispensed regardless of whether or not the transaction is accepted.

41 Claims, 9 Drawing Sheets

COIN COUNTER/SORTER AND COUPON/VOUCHER DISPENSING MACHINE AND METHOD

This is a continuation of application Ser. No. 07/940,931, filed Sep. 4, 1992, now abandoned.

BACKGROUND OF THE INVENTION

The present invention relates to coupon dispensing machines and coin sorting machines.

There are a variety of machines which dispense stamps, tickets, coupons, money orders, bank transactions or the like. One type of machine, shown in U.S. Pat. No. 5,039,848 to Raymond Stoken, dispenses coupons in exchange for money. A display area indicates the different coupons available as well as the specific amount of money required to obtain each particular coupon. Money is inserted into the machine via a coin slot. Control circuitry determines which coupon has been selected, the amount of money required to purchase this coupon, and if the correct amount of money has been inserted into the coin slot. The control circuitry then causes the coupon dispenser to dispense the requested coupon.

Other machines dispense other types of products. For instance, U.S. Pat. No. 5,021,967 to Lawrence Smith is a money order dispensing machine. This machine is meant to be operated by a system operator, not a customer, and therefore does not require the capability to receive money. The machine prints money orders on a dot matrix printer after receiving the necessary data inputs from the operator.

A different variety of machines has been patented which sort coins. One such machine, shown in U.S. Pat. No. 4,995,848 to David Goh uses two methods to sort coins, both methods based on the diameter of the coins. In this machine the coins are loaded into a hopper. A rotating wheel feeds the coins individually onto an inclined ramp. The coins roll down the ramp with their rear surfaces resting against a support surface. Specific denominations are selected when they fall through slots of varying size located in the support surface. Specific denominations are also selected using peeler knives which are arranged at different distances from the ramp surface. These knives topple the coins from the ramp into bins. Using both techniques allows a short ramp to be employed. Another type of machine shown in U.S. Pat. No. 4,059,122 to Yoshio Kinoshita counts the number of coins according to denomination after sorting the coins.

SUMMARY OF THE INVENTION

The present invention provides an apparatus which can receive a number of unsorted coins. The coins are sorted and counted to determine a total value. The user is issued a voucher for an amount related to the total value.

The present invention offers a valuable service to the retailer in whose store this machine is placed as well as to the actual user. People tend to collect coins at home, finding that carrying large quantities of coins is unwieldy and impractical. Furthermore, spending coins normally requires either placing the coins singularly into product dispensing machines or counting the coins out by hand. This invention allows the user to periodically exchange excess coins for cash vouchers. The user need not first count the coins since the present invention automatically counts the coins. The advantages to the retailer are numerous. First, although the voucher is exchangeable for cash or merchandise, most customers are likely to purchase goods at the store where they exchange their coins. Second, by offering a convenience to their customers, retailers gain the goodwill of these customers. Thus, the present invention provides a voucher issuing machine in which the amount of the voucher is not preset, and also allows coin sorting by a typical consumer.

In the preferred embodiment coins are placed in a hinged hopper tray built into one of the machine's surfaces. To activate the process the user presses a "go" button and then lifts one edge of the tray, causing the coins to fall down a chute to the high speed coin sorting and counting mechanism. Coins are counted and sorted by denomination and then dropped into a temporary holding area called an escrow tray. As the coins are counted, the total monetary value is displayed on a video screen as well as the number of coins counted within each denomination. After all of the coins have been counted, the user is asked to make a decision, either rejecting the transaction or allowing the transaction to proceed. If the transaction is rejected, the coins are returned to the user via a return chute. If the transaction is accepted, the coins are dropped into separate bins or trays based upon their denomination. This triggers the controller to print and dispense a cash voucher to the user via a slot in the machine's surface.

Besides exchanging cash vouchers for coins, in the preferred embodiment the-invention dispenses manufacturers' coupons from a separate slot redeemable for various bargains. These coupons are dispensed at no cost to the user. A second type of coupon to be dispensed in the preferred embodiment are store coupons. These coupons are printed by the cash voucher printer and dispensed through the same slot as the cash vouchers and are good only for specific bargains unique to that store. For example, the store manager may have a surplus of a particular item and therefore wish to offer a "two-for-one" bargain for a limited time. Selected products and bargains may also be promoted on the video display. These promotional techniques have the advantage of being easily alterable; thus an individual store manager can tailor the store coupons/ads depending upon factors such as the time of day (e.g., midday grocery store shoppers versus after work shoppers versus late night shoppers) while the chain store owner can vary the store coupons/ads depending upon a particular store's location and needs (e.g., deli shop versus bakery shop versus floral shop).

Generally, in the prior art, coins are either inserted into a machine singularly, or in the case of large commercial sorting machines, by trained personnel. In the present invention, non-trained personnel will dump large amounts of coins into the hopper tray. These untrained users are likely to empty their personal containers, such as old cans or bottles, directly into the hopper without first inspecting the coins. Thus lint, tokens, and various other objects will probably accompany the coins into the machine. Therefore a method of waste management is necessary to insure that the machine is not damaged during use.

In the preferred embodiment, the user dumps coins into a hopper tray which doubles as an inspection area. The bottom of the hopper tray is perforated, thus allowing small foreign objects to fall through the perforations instead of entering the coin sorting mechanism. While the coins are in the hopper, the user has an opportunity to remove large foreign objects. After inspecting the coins, the user first presses a "go" button indicating they wish to use the machine, and then lifts one edge of the hinged tray, causing the coins to fall down a waste management chute. This chute leads to the coin sorting and counting mechanism. In the preferred embodiment, when the "go" button is pressed, the coin sorter starts, the coin counter is initialized, and a fan within the waste management chute is activated. The fan blows light weight debris, such as lint and dust, out of the chute and away from the coin counter/sorter mechanism. The bottom surface of the waste management chute is a grooved and porous plate which allows any fluids dumped into the machine to be removed from the coins and collected. This helps to avoid possible damage to the machine. Magnetic strips are placed along the entrance and exit areas of the chute to extract any magnetic tokens which may have been included with the coins.

Many people have an intrinsic distrust of machines, especially with regards to machines handling their money, and therefore it is desirable to quickly gain the user's trust. This invention has several features which accomplish this goal. First, the front of the machine is 61ear, encouraging user trust since the flow of coins can be watched throughout the process. Second, until the voucher is issued, the user is in control of the process. Prior to issuing the voucher the display indicates the amount of the coins counted. At this point the user can either agree with the amount and allow the transaction to proceed, or can reject the amount and have the coins returned. Until the user makes this decision, the coins are kept in a temporary holding area called an escrow tray. In the preferred embodiment, the basic escrow tray is immobile although the bottom surface of the tray can be manipulated. Through the manipulation of this surface, the coins are either returned to the user or dumped into a storage bin within the machine.

DESCRIPTION OF THE SPECIFIC EMBODIMENT(S)

Figure 1:
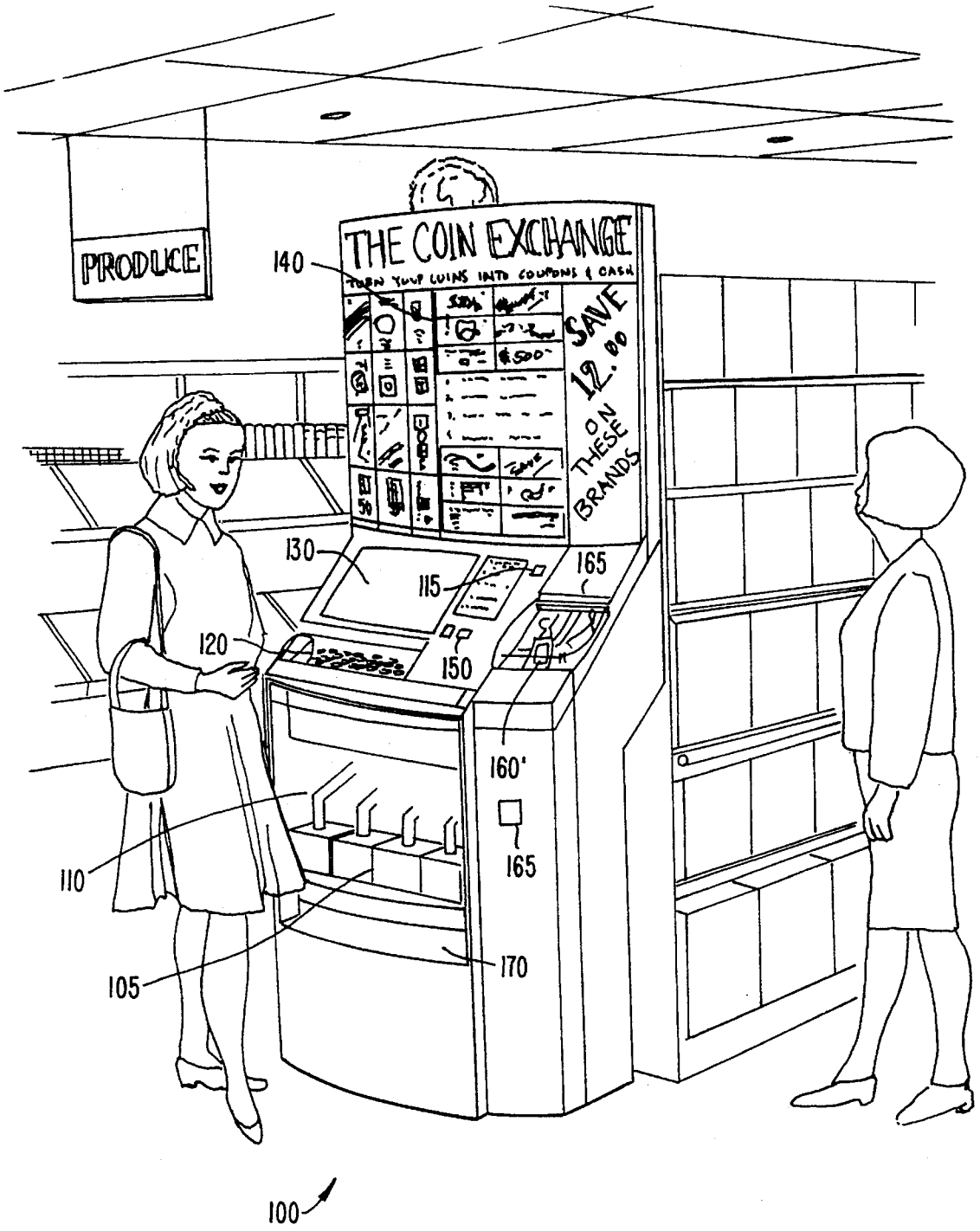
FIG. 1 is an illustration of an embodiment of the coin exchange apparatus in a likely environment.

FIG. 1 is an illustration of the coin exchange kiosk 100 in a possible environment; a supermarket. Kiosk 100 is free-standing, and has been designed with a small footprint to minimize the required floor space. The lower front surface 110 is clear, allowing the user to watch the coins as they are separated, counted, and dropped into escrow tray 105. By making the process visible to the user, trust in the machine is encouraged. Furthermore, since watching the sorting process is interesting, the user becomes integrated into the machine's operation and is further encouraged to use the machine.

Initially the coins are placed in coin tray 120 where small foreign objects fall through perforations in the bottom of the tray and the user can remove large foreign materials prior to coin sorting. When the user is ready to begin the sorting process, they must push "go" button 115. Button 115 initializes the coin counter, activates the coin sorter, and activates the fan within the waste management chute. If the system does not detect coins within a predetermined period of time, both the coin sorter and the fan are deactivated. The user next raises the edge of tray 120. The tray is hinged on the right side and acts as a chute to funnel the coins into the kiosk. User directions, transaction information, store bargains, and advertisements appear on video screen 130. Screen 130 can also be used to show attention getting displays in order to attract potential users. Once the coins are admitted into the kiosk and the go button has been pushed, the waste removal and coin sorting process begins. During the coin sorting process, coins which do not meet the necessary physical criteria are rejected and returned to the user via chute 165. In the preferred embodiment, as the coins are counted the video screen displays both the total monetary value and the number of coins collected within each denomination.

At the conclusion of the sorting process, the user is asked to either accept the stated coin value and continue the transaction, or cancel the transaction. This selection is made by pushing one of two buttons 150. If the user continues the transaction, then the coins in the escrow tray 105 are dumped into a depository and the user is issued a voucher through slot 160. In the preferred embodiment, the voucher is worth the value of the counted coins and is redeemable at the retailer's cashier for cash or credit towards purchases. Store coupons, printed by the voucher printer and good towards store bargains, are dispensed with the cash voucher. Manufacturers' coupons are dispensed through an adjoining slot 165 at no cost to the user. If the user cancels the transaction the coins are returned in area 170. The upper back portion 140 of kiosk 100 is a display board where advertisements and notices can be placed. Display board 140 can also be used to indicate what coupons the machine is currently dispensing.

Figure 2:
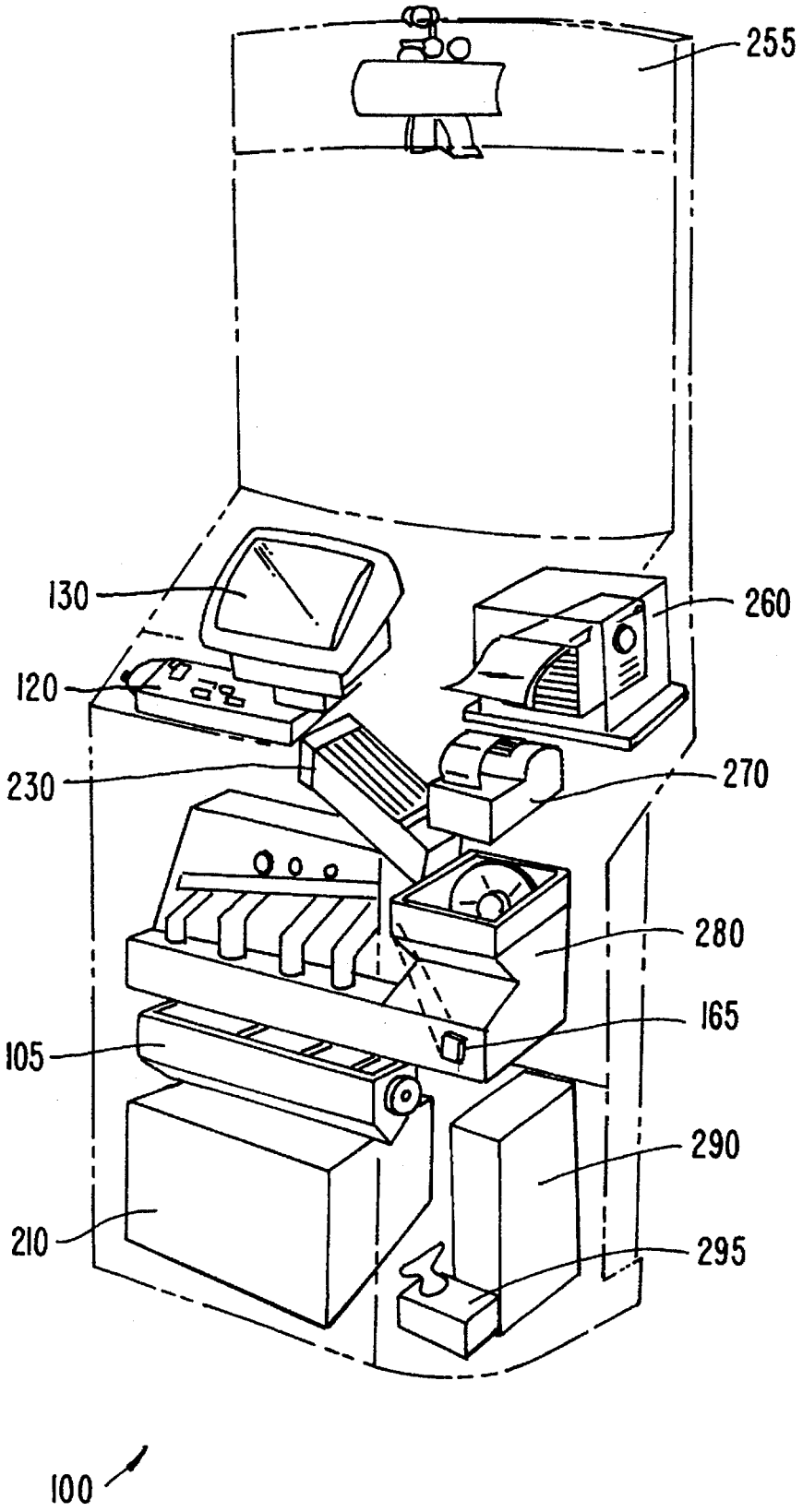
FIG. 2 is a diagram showing the internal layout of the principal components in the preferred embodiment.

The internal layout of kiosk 100 is shown in FIG. 2. The coin storage area 210 holds the coins after the transaction has been completed. Area 210 can either be separated into large capacity bins to hold each denomination, or into ready to use coin trays. When the storage area is close to capacity, an indicator 255 on the outside of the kiosk 100 notifies store personnel to empty the storage area 210.

The outside of the waste management system 230 is visible in this diagram. Liquids fall through the porous, grooved bottom plate of system 230 while lint and other fine materials are blown away by a small fan located in the chute. Liquids are collected in a waste receptacle. At the end of system 230, the coins are funneled into the coin counter and sorter 280. This is a commercially available sorter. Several manufacturers make suitable machines, although in the preferred embodiment a Scan Coin Model 109 with a modified hopper is used. The counter accepts mixed coins and is able to detect foreign coins and slugs. Rejected coins are returned to the user through chute 165.

Two different printers are used in the preferred embodiment of the kiosk. Printer 270 is used to print the cash vouchers and the store coupons. The preferred embodiment uses an Epson TM267 printer. Besides containing the amount of the voucher, the voucher will also contain other information such as store name, transaction number, bar codes, etc in order to make counterfeiting difficult. Special papers and inks can also be used to discourage counterfeiting. In the preferred embodiment, a separate printer 295 makes a continuous record of each transaction. This printer is an Epson RP265. In a second embodiment printer 270 serves a double function. Besides printing the vouchers, upon command by store personnel this printer prints out all of the pertinent transactional information. CPU 290 also stores this information.

In the preferred embodiment, VGA screen 250 is a Super VGA monitor; CPU 290 is a Belmont, 386, 40 MHz CPU; and high capacity sheet feeder 260 is a modified 1000 sheet feeder manufactured by Gradco, model number HCF-1000. Warning light 255 warns store personnel when either printer is low on paper, the sheet feeder is low on paper, or there has been a system malfunction.

Figure 3:
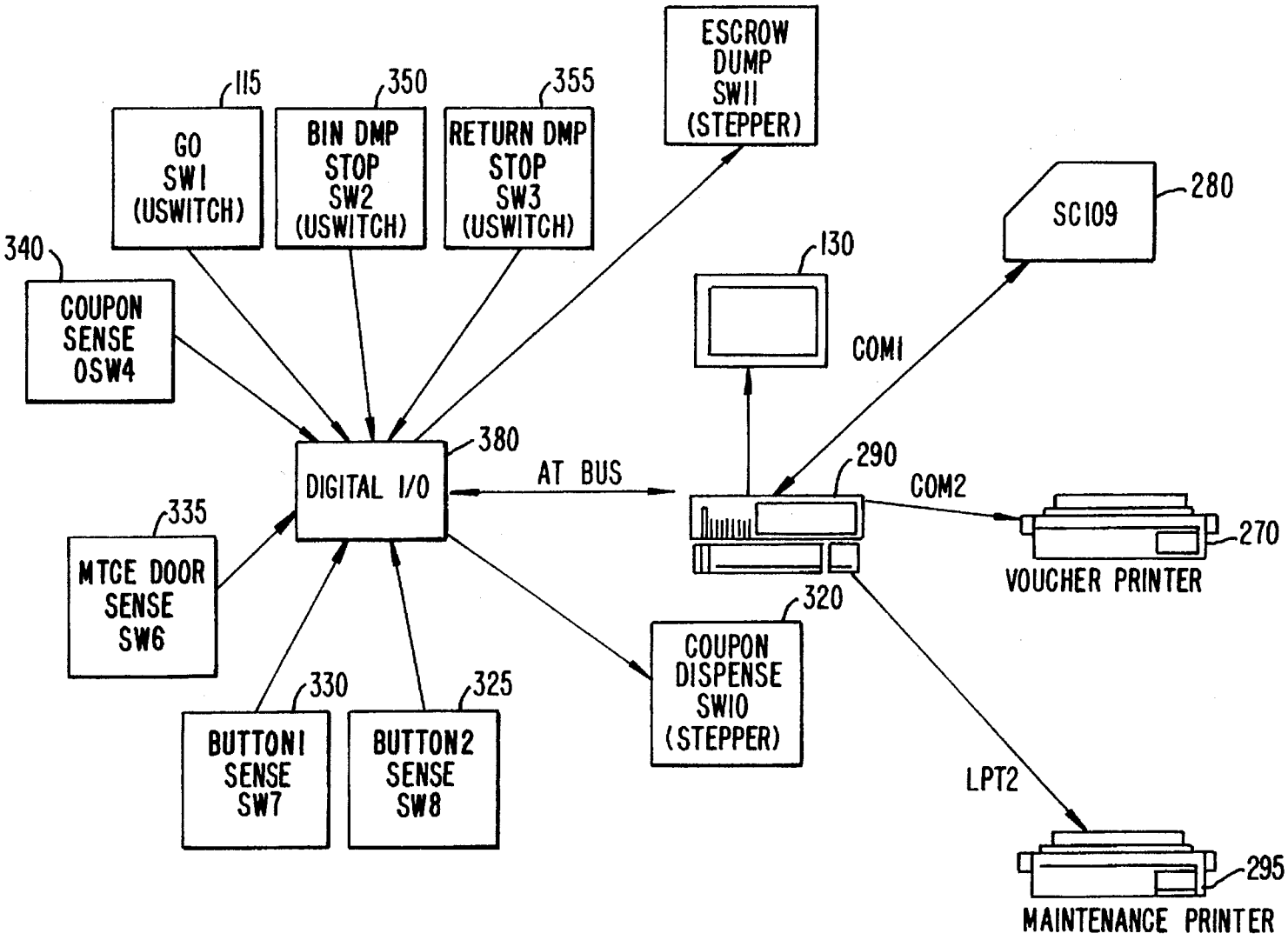
FIG. 3 is a block diagram of the system level electronic functions.

FIG. 3 is a block diagram of the system level electronic functions. The entire system is controlled by CPU 290. System information is presented on display 130 which is the same monitor used to communicate with the user. System inputs are coupled to CPU 290 via data bus 380. Push button switches 330 and 325 are used by the user to either accept or cancel the transaction. Switch 335 is a maintenance switch which is used by store personnel to command the system to download system information to either the maintenance printer 295 or to a floppy disk. The maintenance switch may also be used to enter a mode to allow clearing of coin jams and an internal store coin counting mode. This internal store coin counting mode will enable the retailer to sort and count coins from vending machines and cash registers, bypassing the voucher and coupon functions. Leading edge sensor 340 tells the system each time a sheet of coupons has been dispensed. Stepping motor 320 dispenses the coupon sheets. Push button switch 115 is depressed by the user to initialize the counting system and activate both the coin counter/sorter 280 and the waste management fan. Microswitches 350 and 355 deactivate escrow tray stepping motor 360, thus preventing possible mechanical damage by the stepping motor moving the tray past its designated limits, and indicate to CPU 290 the position of the escrow tray (i.e., at-rest position, returning coins to the user position, or dumping coins into the machine's storage area position). CPU 290 also controls the voucher printer 270.

Figure 4:
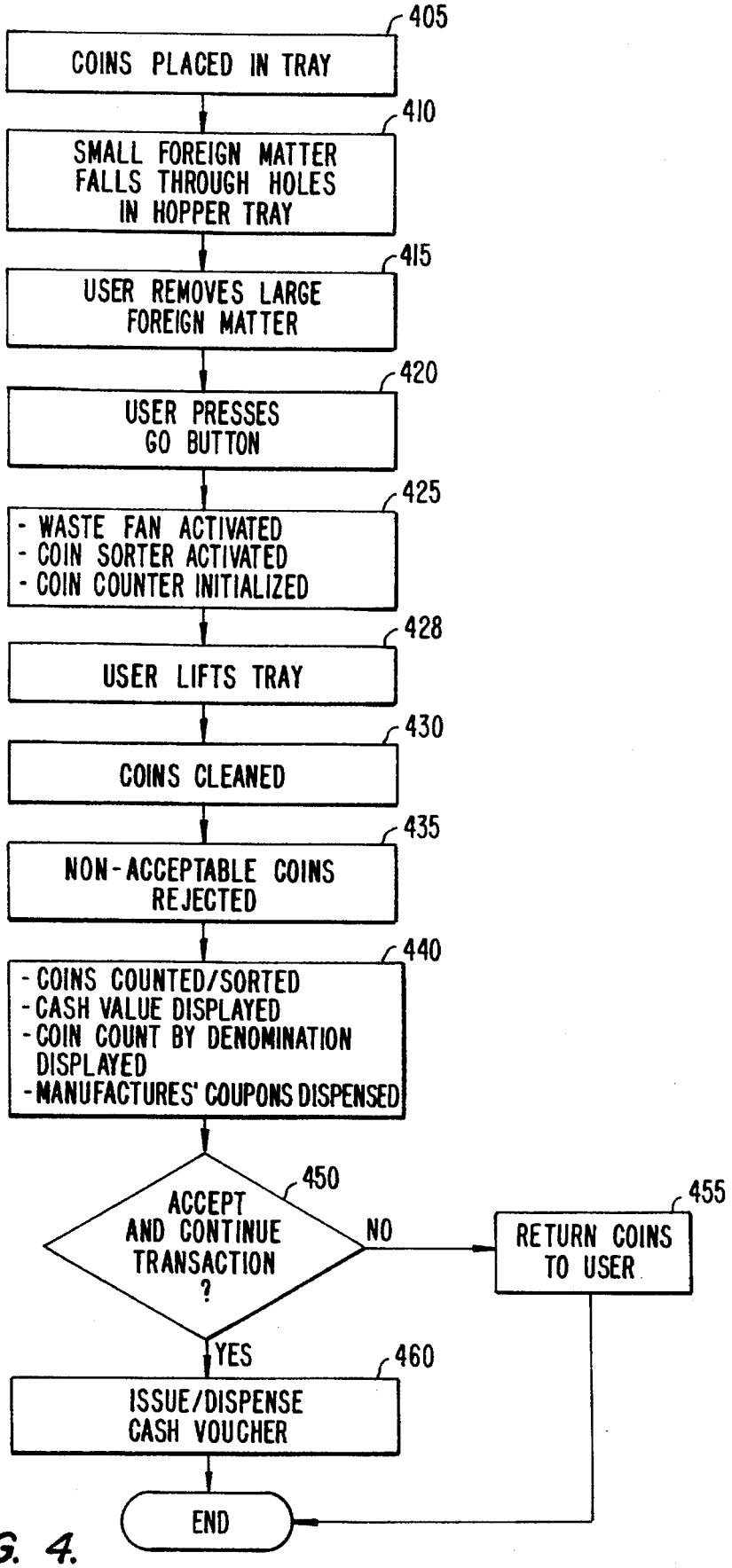
FIG. 4 is a flow chart of the operation of the system.

The flowchart of FIG. 4 illustrates the operation of the coin exchange kiosk in its preferred embodiment. The user places coins of varying denominations into the external tray (step 405). Small foreign matter falls through perforations in the bottom of the hopper tray (step 410) while large foreign matter is removed by the user (step 415). When the user is ready to begin using the machine, they press the "go" button (step 420). Pressing the go button activates the coin sorter, initializes the coin counter, and activates the fan within the waste management chute (step 425). Next the user lifts the edge of the hopper tray, dumping the coins down the entrance chute of the waste management system (step 428). As the coins go through the waste management system certain waste, such as liquids, are removed (step 430). The coins are then counted and sorted (step 440). During this step coins which do not meet the necessary physical criteria are rejected and returned to the user (step 435). As the coins are counted, the value of the coins is displayed on the monitor as well as the number of coins counted within each denomination (step 440). Manufacturers' coupons are dispensed at this time (step 440). After all of the coins are counted, the user is asked to either accept the value that has been determined and continue the transaction or to reject the value and discontinue the transaction (step 450). If the user decides to reject the stated value then the coins are returned (step 455). If the user decides to accept the stated value and continue the transaction then a cash voucher is dispensed for the stated value (step 460).

Figure 5:
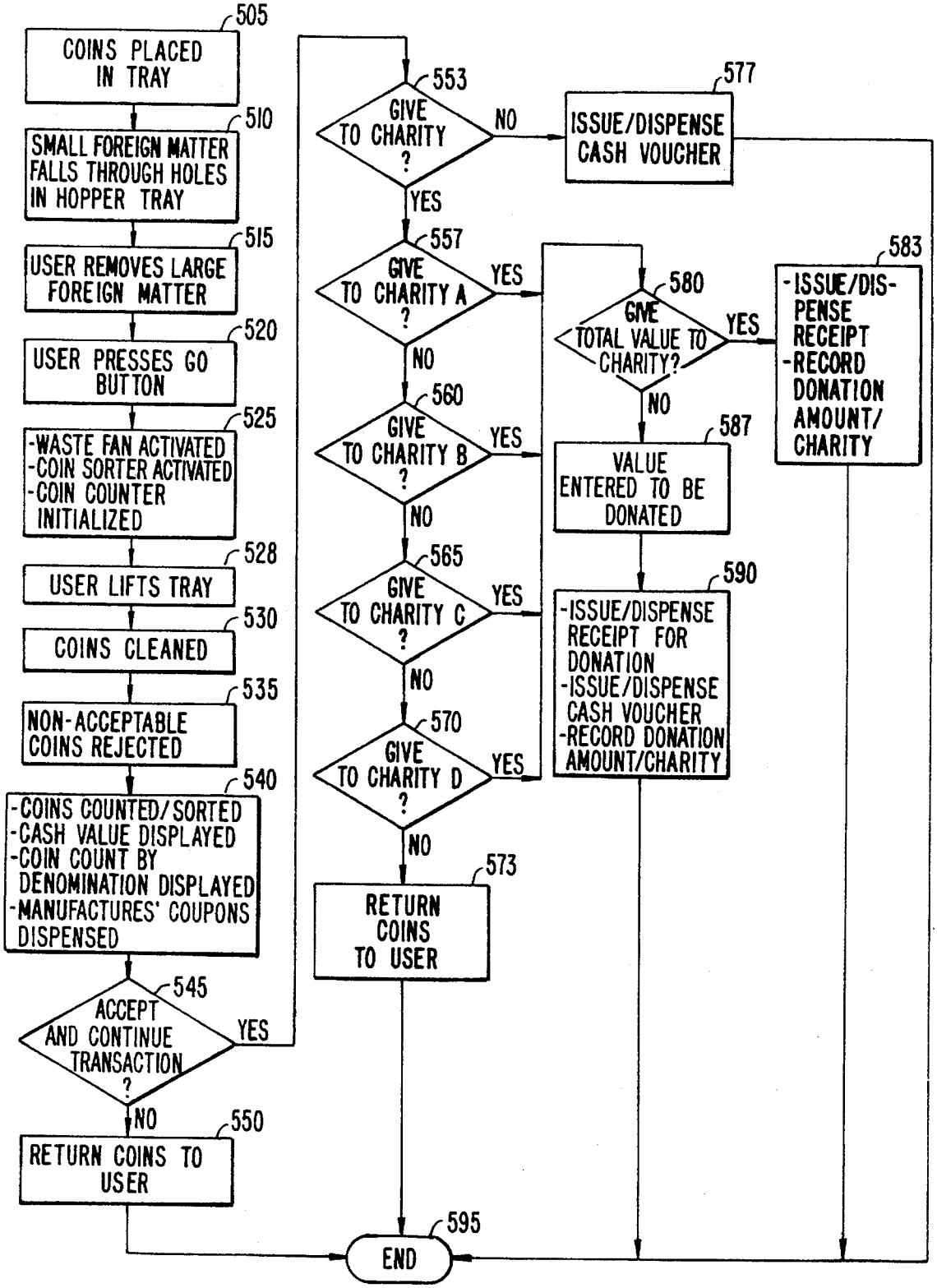
FIG. 5 is a flow chart of the operation of a second embodiment of the system.

The flowchart of FIG. 5 illustrates the operation of the coin exchange kiosk in a second embodiment. The user places coins of varying denominations into the external tray (step 505). Small foreign matter falls through perforations in the bottom of the hopper tray (step 510) while large foreign matter is removed by the user (step 515). When the user is ready to begin using the machine, they press the "go" button (step 520). Pressing the go button activates the coin sorter, initializes the coin counter, and activates the fan within the waste management chute (step 525). Next the user lifts the edge of the hopper tray, dumping the coins down the entrance chute of the waste management system (step 528). As the coins go through the waste management system certain waste, such as liquids, are removed (step 530). The coins are then counted and sorted (step 540). During this step coins which do not meet the necessary physical criteria are rejected and returned to the user (step 535). As the coins are counted, the value of the coins is displayed on the monitor as well as the number of coins counted within each denomination (step 540). Manufacturers' coupons are dispensed at this time (step 540). After all of the coins are counted, the user is asked to either accept the value that has been determined and continue the transaction or to reject the value and discontinue the transaction (step 545). If the user decides to reject the stated value then the coins are returned (step 550) and the transaction ends (step 595).

If the user decides to accept the stated value and continue the transaction then they are asked whether they would like to donate, in whole or in part, the value of the coins to a charity (step 553). If the user does not wish to donate to a charity then a cash voucher is issued (step 577) and the transaction ends (step 595). If the user wishes to donate to a charity, then the user is asked to chose to which charity they wish to donate (steps 557, 560, 565, and 570). If they do not wish to donate to any of the listed charities, then the transaction ends (step 595) and the coins are returned (step 573).

After choosing to which charity they wish to donate, the user is asked if they wish to donate the total value of the coins (step 580). If the user wishes to donate the total amount then a receipt is issued which states the amount and the charity (step 583). CPU 290 records the amount donated and the charity (step 583) so that when the coins are removed from kiosk 100 the proper amounts can be deposited to the appropriate charity organizations. If the user selects to donate only a portion of the total amount, they then enter the amount to be donated (step 587). At this point a receipt for the donated portion is issued, a cash voucher for the remainder of the total amount is issued, and CPU 290 records the amount donated and the charity for later disbursement of funds (step 590).

Figure 6:
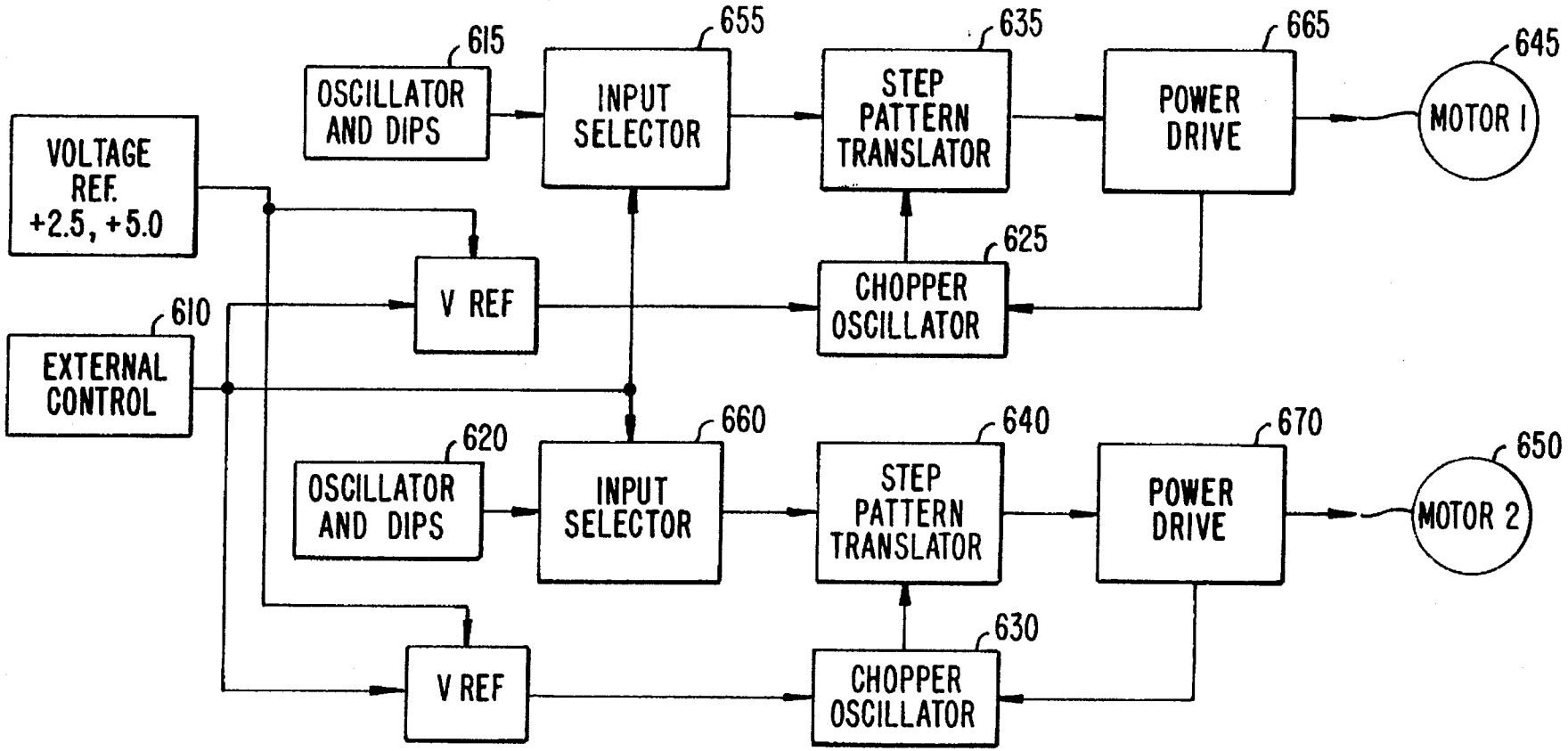
FIG. 6 is a block diagram of the stepping motor control circuitry.

FIG. 6 is a block diagram of the stepping motor control circuitry for the two stepping motors used in kiosk 100. One stepping motor controls the coupon dispenser and the other stepping motor controls the escrow tray. The circuitry for the two motors are duplicates of one another. The oscillators in blocks 615 and 620 generate the pulses which set the stepping motor rates. The dip switches in blocks 615 and 620 allow manual setting of the oscillator rates. Each motor has a second oscillator, blocks 625 and 630, which set the chopping rate. The step pattern translators, blocks 635 and 640, use both oscillators to generate the step motor patterns. Two different oscillators are used in order to maximize the power efficiency.

In operation, computer 290 determines when power should be supplied to either the coupon dispenser stepping motor 645 or the escrow tray stepping motor 650. This input is supplied via interface 610. This signal is received by either input selector 655 or 660. In the preferred embodiment, this signal is digital. Depending upon the signal, the selector determines the length of time the stepping motor will be operated. For example, one signal from interface 610 will cause the coupon dispenser (motor 645) to dispense only a single sheet of coupons while a different signal will cause two sheets of coupons to be dispensed. Similarly, one signal from interface 610 will cause the escrow tray (motor 650) to rotate in one direction thereby returning coins to the user, while a different signal will cause the opposite motor rotation thereby depositing the coins into the coin receptacle. The power drive units 665 and 670 supply, upon command, sufficient power to operate stepping motors 645 and 650.

Figure 7:
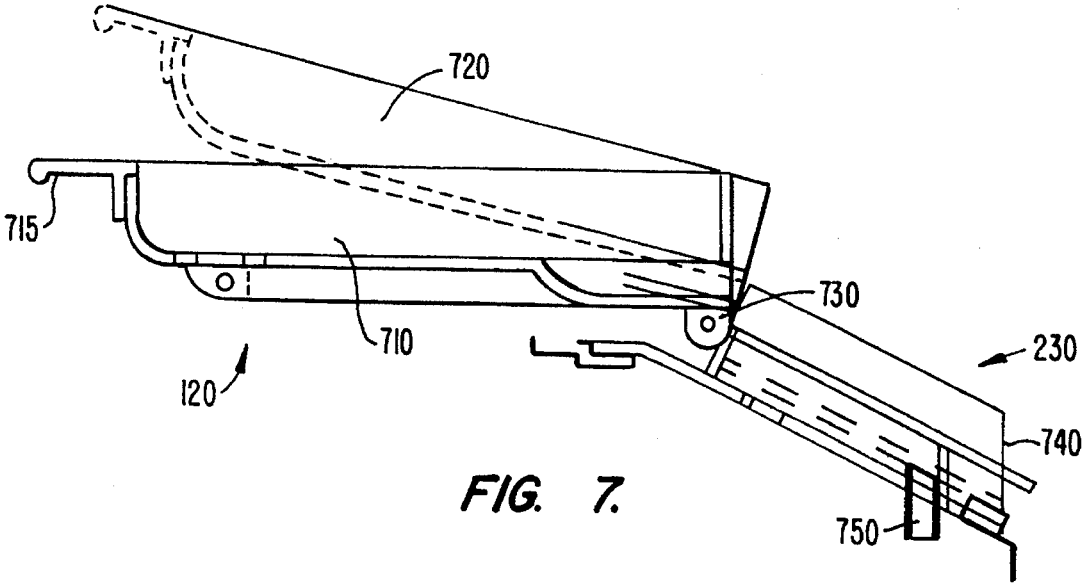
FIG. 7 is a side view of the coin tray and the waste management system.

FIG. 7 is a side view of coin tray 120 and waste management chute 230. Coin tray 120 normally is flush with the top surface of kiosk 100 (Position 710). The user places their coins in the tray and at this point removes any obvious foreign materials. When the user is ready to begin the sorting process, they lift handle 715 on coin tray 120. The tray is hinged at point 730. When tray 120 is in position 720, the coins fall through waste management chute 230. The coins leave chute 230 through opening 740 to enter the coin sorting and counting mechanism. Liquids accidently dropped into the coin hopper are funneled through spout 750 to a suitable collection receptacle.

Figure 8A:
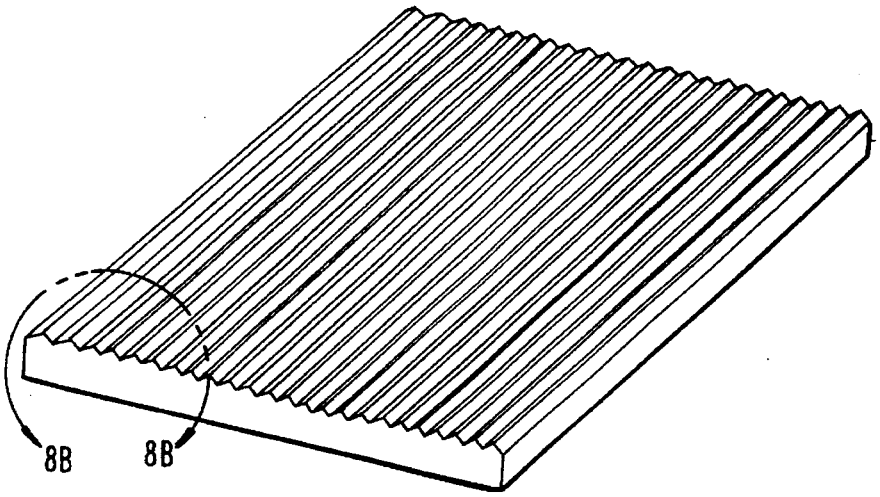
FIGS. 8A—B is a diagram of the bottom plate of the waste management system.
Figure 8B:
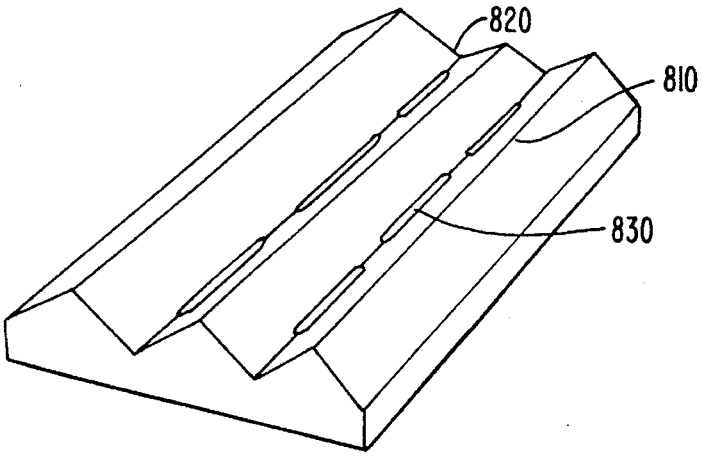

FIG. 8A is a diagram of the bottom plate of waste management system 230. FIG. 8B is an enlarged view of a small section of this plate. The surface of the plate has grooves running lengthwise, these grooves forming a series of alternating peaks 810 and valleys 820. The coins ride along the surface of the plate while liquids flow down the valleys 820, eventually flowing through perforations 830 drilled in the bottom of the valleys 820. The liquids are then funneled down spout 750, and collected. The sharp peaks 810, combined with a teflon coating, help minimize the friction caused by the liquids which may accompany the coins. This in turn helps prevent a slow down of the sorting process.

Figure 9:
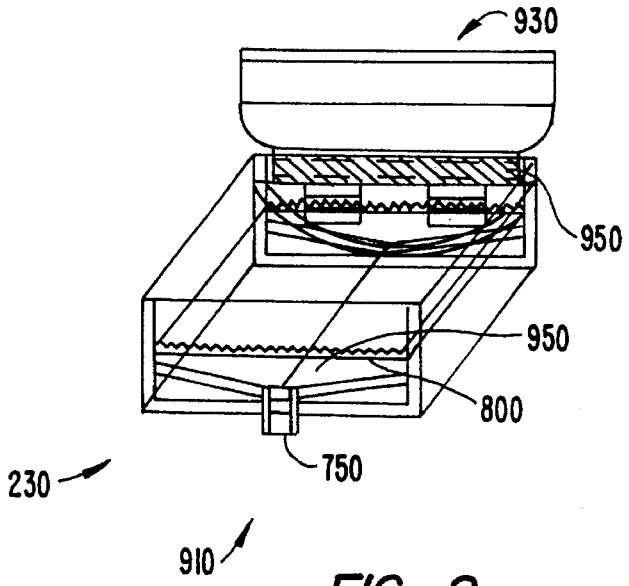
FIG. 9 is a three-dimensional view of the waste management system.

FIG. 9 is a three dimensional view of the waste management chute 230. The coins enter and travel down the chute in direction 930. As the coins travel down this chute, a fan (not shown) blows air back up the chute in direction 910. Light materials, such as small papers and lint, are blown free from the coins and out of the machine. Liquids flow through the holes in bottom plate 800, flow through spout 750, and are collected in a separate receptacle. Magnetic strips 950 along the exit edge of the coin hopper and the entry edge of the waste management chute collect ferrous objects, such as tokens and slugs, removing them from the coins.

Figure 10:
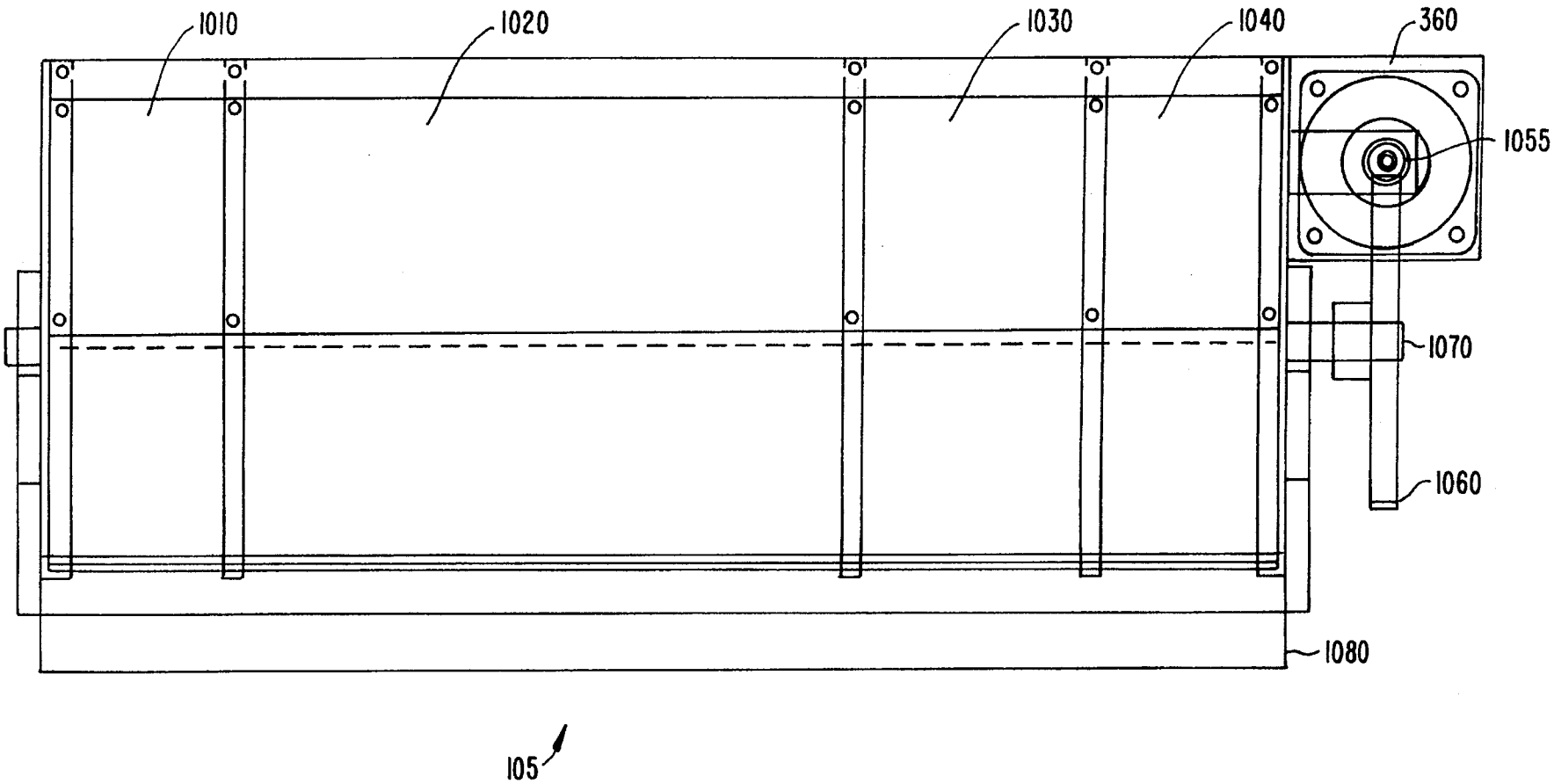
FIG. 10 is a front view of the escrow tray.

FIG. 10 is a front view of the escrow tray 105. Tray 105 is divided into four bins. Bin 1010 catches dimes from sorter 280; bin 1020 catches pennies; bin 1030 catches nickels; and bin 1040 catches quarters. Stepping motor 360 drives worm gears 1055 and 1060. When activated, stepping motor 360 moves the bottom surface 1080 of the tray along axis 1070. If the tray bottom 1080 is rotated outward, toward the user, the coins are dumped into a coin storage receptacle. If the tray bottom 080 is rotated inward, away from the user, then the coins are dumped into a return receptacle.

Figure 11:
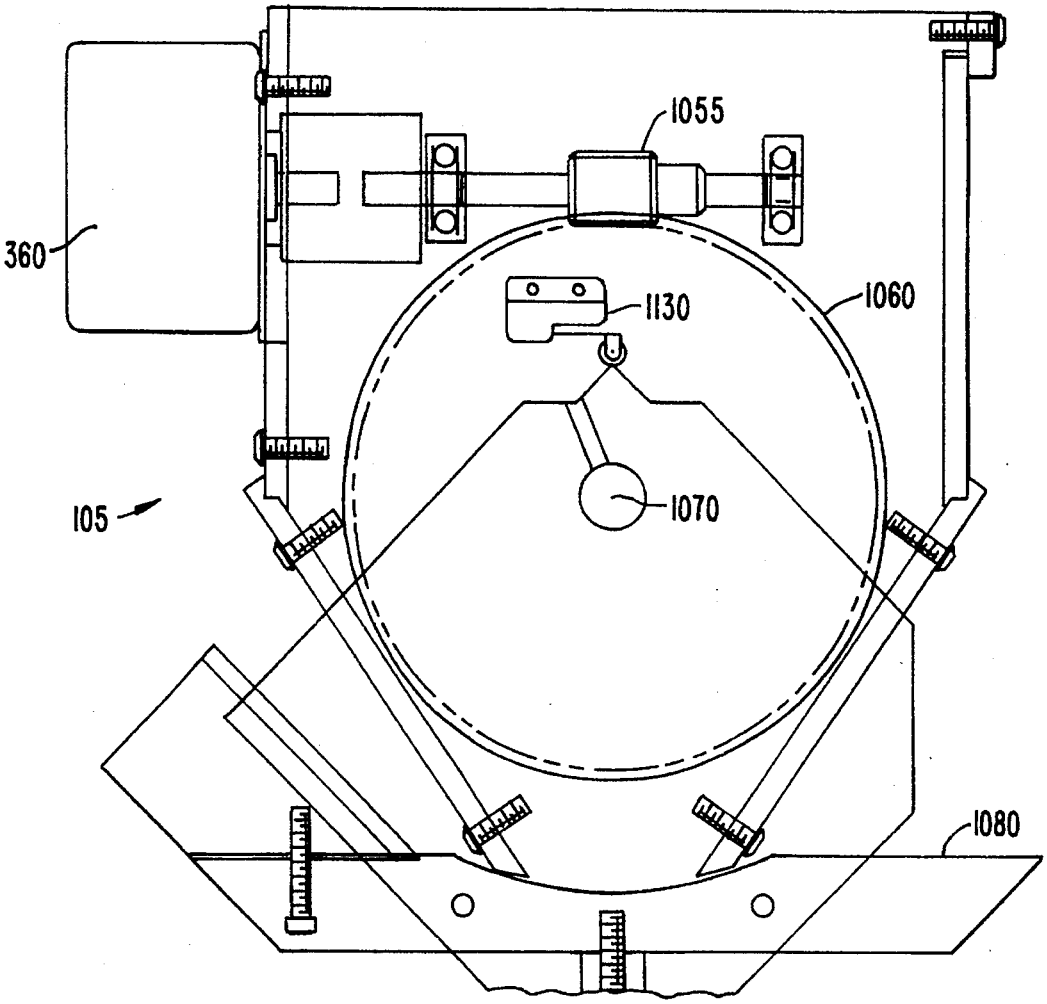
FIG. 11 is a side view of the escrow tray.

FIG. 11 is a side view of the escrow tray 105. Stepping motor 360 drives worm gears 1055 and 1060. When the stepping motor 360 is activated, worm gear 1060 is rotated along axis 1070. When gear 1060 is rotated clockwise, the bottom surface 1080 is rotated allowing the coins to be returned to the user in tray 170. When gear 1060 is rotated counter-clockwise, the bottom surface 1080 is rotated allowing the coins to be dumped into a coin depository. Microswitch 1130 prevents the stepping motor from moving the tray bottom 1080 past its pre-determined stops.

As will be understood by those familiar with the art, the present invention may be embodied in other specific forms without departing from the spirit or essential characteristics thereof. For example, the same printer could be used to print both the vouchers and periodic maintenance reports. Accordingly, disclosure of the preferred embodiments of the invention is intended to be illustrative, but not limiting, of the scope of the invention which is set forth in the following claims.

What is claimed is:

1. A method for untrained users to obtain a voucher for coins comprising the steps of:

providing a kiosk having first means for discriminating among coin denominations receiving, from said untrained user, in a first location of said kiosk, a plurality of coins of arbitrary denominations;

performing a first step of cleaning said plurality of coins while said coins are in said first location by providing an opening in said first location through which debris may pass;

moving at least some of said coins from said first location to a second location in said kiosk;

performing a second step of cleaning said coins, different from said first step of cleaning, while said coins are in said second location:

discriminating, in said kiosk, said denominations of coins, using said first means, after said steps of performing a first step of cleaning and performing a second step of cleaning;

determining a total amount of said coins; and dispensing, from said kiosk, a voucher redeemable in cash or merchandise for a value related to said total amount wherein said value is determined only after said steps of receiving and determining.

2. The method of claim 1 wherein said step of performing a second step of cleaning comprises the steps of:

blowing any light materials from the coins; and removing any fluids accompanying the coins after said step of moving.

3. The method of claim 1 wherein said step of performing a second step of cleaning comprises the steps of:

vacuuming any light materials from the coins; and removing any fluids accompanying the coins after said step of moving.

4. The method of claim 1 wherein said coins include currency, tokens, slugs, and damaged and/or irregular coins.

5. The method of claim 1 further comprising the steps of:

counting a number of coins within each denomination; and displaying the value of said coins within each denomination.

6. The method of claim 1 wherein said value of said voucher is equal to the value of coins deposited.

7. The method of claim 1 wherein said value of said voucher is equal to the value of the coins deposited less a fee.

8. The method of claim 1 wherein said value of said voucher is equal to the value of the coins deposited plus a bonus.

9. The method of claim 1 further comprising the steps of:

allowing the user to choose to donate to charity in whole or in part the value of said coins;

allowing the user to choose between different charity organizations;

maintaining a record of the value to be donated;

maintaining a record of the charity organization chosen;

dispensing a receipt for the value donated to charity; and dispensing a cash voucher for the difference between said value related to said total amount and the value of said donation.

10. A method, as claimed in claim 1, further comprising:

exchanging said voucher for cash or merchandise having a value related to said total amount.

11. A method, as claimed in claim 1, further comprising printing out pertinent transactional information, in addition to said voucher.

12. A method, as claimed in claim 1, further comprising storing pertinent transactional information, using a computer.

13. A method, as claimed in claim 1, further comprising providing a coin storage area for storing said coins after sorting.

14. A method, as claimed in claim 1, further comprising outputting a notification when said coin storage area is close to capacity.

15. A method, as claimed in claim 1, wherein said value related to said total amount is a value at least equal to said total amount.

16. A method, as claimed in claim 15, wherein said value can be any monetary value.

17. A method, as claimed in claim 1, further comprising outputting apparatus maintenance reports.

18. A method, as claimed in claim 9, wherein said step of maintaining a record of the value to be donated comprises using a computer to record the amount donated.

19. A method for untrained users to obtain a voucher for coins comprising the steps of:

providing a kiosk having first means for discriminating among coin denominations;

receiving, from said untrained user, in a first location of said kiosk, a plurality of coins of arbitrary denomination;

performing a first step of cleaning said plurality of coins while said coins are in said first location by providing an opening in said first location through which debris may pass;

moving at least some of said coins from said first location to a second location in said kiosk;

performing a second step of cleaning said coins, different from said first step of cleaning, while said coins are in said second location;

discriminating, in said kiosk, said denominations of coins, using said first means;

dispensing discount coupons;

determining a total amount of said coins; and dispensing, from said kiosk, a voucher, different from said discount coupons, redeemable in cash or merchandise for a value related to said total amount.

20. The method of claim 19 wherein said coupon dispensing step comprises dispensing coupons based on the value of the coins deposited.

21. The method of claim 19 wherein said coupon dispensing step comprises dispensing coupons based on the number of coins deposited.

22. The method of claim 19 wherein said coupon dispensing step comprises dispensing coupons regardless of the number or value of coins deposited.

23. A method for untrained users to obtain a voucher for coins comprising the steps of:

providing a kiosk having first means for discriminating among coin denominations;

receiving, from said untrained user, in a first location, a plurality of coins of arbitrary denomination;

performing a first step of cleaning said plurality of coins while said coins are in said first location by providing an opening in said first location through which debris may pass;

moving at least some of said coins from said first location to a second location in said kiosk;

performing a second step of cleaning said coins, different from said first step of cleaning, while said coins are in said second location;

discriminating, in said kiosk, said denominations of coins, using said first means;

determining a total amount of said coins;

displaying, in said kiosk, the total amount of said coins;

dispensing, from said kiosk, manufacturers' coupons;

holding the coins in an intermediate holding area;

returning the coins to the user in response to a user input rejecting the total amount;

depositing the coins into a storage area in response to a user input accepting the total amount; and dispensing, from said kiosk, a voucher redeemable in cash or merchandise for a value related to said total amount in response to a user input accepting the total amount.

24. The method of claim 23 further comprising the steps of:

pivoting the intermediate holding area to return the coins to the user in response to a user input rejecting the total amount; and pivoting the intermediate holding area to deposit the coins into a storage area in response to a user input accepting the total amount.

25. An apparatus for allowing untrained users to obtain a voucher for coins comprising:

a kiosk, having means for discriminating among coin denominations;

means for receiving, from said untrained user, in a first location of said kiosk, a plurality of coins of arbitrary denomination from a user;

means, coupled to said means for receiving, for performing a first step of cleaning said plurality of coins while said coins are in said first location by providing an opening in said first location through which debris may pass;

means for moving at least some of said coins from said first location to a second location in said kiosk;

means for performing a second step of cleaning said coins, different from said first step of cleaning, while said coins are in said second location;

means, coupled to said second location, for determining a total amount of said coins; and means, coupled to said means for determining, for dispensing, from said kiosk, a voucher redeemable in cash or merchandise for a value related to said total amount wherein said value is determined only after said means for determining has determined said total amount.

26. The apparatus of claim 25 wherein said means for performing said second step of cleaning comprises:

means for blowing any light materials from the coins; and means, coupled to said means for blowing, for removing any fluids accompanying the coins.

27. The apparatus of claim 25 wherein said means for performing said second step of cleaning comprises:

means for vacuuming any light materials from the coins; and means, coupled to said means for vacuuming, for removing any fluids accompanying the coins.

28. The apparatus of claim 25 wherein said coins include currency, tokens, slugs, and damaged and/or irregular coins.

29. The apparatus of claim 25 further comprising:

means for counting a number of coins within each denomination; and means, coupled to said means for counting, for displaying the value of said coins within each denomination.

30. The apparatus of claim 25 wherein said value of said voucher is equal to the value of coins deposited.

31. The apparatus of claim 25 wherein said value of said voucher is equal to the value of the coins deposited less a fee.

32. The apparatus of claim 25 wherein said value of said voucher is equal to the value of the coins deposited plus a bonus.

33. An apparatus for allowing an untrained user to obtain a voucher for coins comprising:

a kiosk, having means for discriminating among coin denominations;

means for receiving, from said untrained user, in a first location of said kiosk, a plurality of coins of arbitrary denomination from a user;

means, coupled to said means for receiving, for performing a first step of cleaning said plurality of coins while said coins are in said first location by providing an opening in said first location through which debris may pass;

moving at least some of said coins from said first location to a second location in said kiosk;

performing a second step of cleaning said coins, different from said first step of cleaning, while said coins are in said second location;

means, in said kiosk, for dispensing manufacturers' coupons;

means, coupled to said means for receiving, for determining a total amount of said coins; and means, coupled to said means for determining, for dispensing a voucher redeemable in cash or merchandise for a value related to said total amount.

34. The apparatus of claim 33 wherein said coupon dispensing means comprises dispensing coupons based on the value of the coins deposited.

35. The apparatus of claim 33 wherein said coupon dispensing means comprises dispensing coupons based on the number of coins deposited.

36. The apparatus of claim 33 wherein said coupon dispensing means comprises dispensing coupons regardless of the number or value of coins deposited.

37. The apparatus of claim 33 further compromising:

means, coupled to said means for determining, for allowing the user to donate to charity in whole or in part the value of said coins;

means, coupled to said means for allowing the user to donate to charity, for allowing the user to choose between different charity organizations;

means, coupled to said means for allowing the user to choose between different charity organizations, for maintaining a record of the value to be donated;

means, coupled to said means for maintaining a record of the value donated, for maintaining a record of the charity organization chosen;

means, coupled to said means for maintaining a record, for dispensing a receipt for the value donated to charity; and means, coupled to said means for dispensing a receipt, for dispensing a voucher for the difference between said value related to said total amount and the value of said donation.

38. An apparatus for allowing an untrained user to obtain a voucher for coins comprising:

a kiosk, having means for discriminating among coin denominations;

means for receiving, from said untrained user, in a first location of said kiosk, a plurality of coins of arbitrary denomination;

means, coupled to said means for receiving, for performing a first step of cleaning said plurality of coins while said coins are in said first location by providing an opening in said first location through which debris may pass;

means for moving at least some of said coins from said first location to a second location in said kiosk;

means for performing a second step of cleaning said coins, different from said first step of cleaning, while said coins are in said second location;

means, in said kiosk, for dispensing manufacturers' coupons;

means, coupled to said means for receiving, for sorting said coins into groups, with each group being one of said denominations;

means, coupled to said means for sorting, for determining a total amount of said coins;

means, coupled to said means for determining, for displaying the total amount of said coins;

means, coupled to said means for sorting, for holding the coins in an intermediate holding area;

means, coupled to said means for holding, for returning the coins to the user in response to a user input rejecting the total amount;

means, coupled to said means for holding, for depositing the coins into a storage area in response to a user input accepting the total amount; and means, coupled to said means for discriminating, for dispensing a voucher redeemable in cash or merchandise for a value related to said total amount.

39. The apparatus of claim 38 further comprising:

means for pivoting the intermediate holding area to return the coins to the user in response to a user input rejecting the total amount; and means for pivoting the intermediate holding area to deposit the coins into a storage area in response to a user input accepting the total amount.

40. An apparatus for allowing untrained users to obtain a voucher for coins comprising:

a kiosk, having means for discriminating among coin denominations;

a tray, in said kiosk, for receiving a plurality of coins of arbitrary denomination from said untrained user, said tray having openings in its bottom for allowing waste to fall through, said tray being movable to move said coins to an output end thereof, such that some waste is separated from said coins through said openings as said coins move to said output end as said tray is moved by said untrained user; means, separate from and coupled to said tray, for removing additional waste included among said coins;

means, coupled to said means for discriminating, for determining a total amount of said coins;

means, coupled to said means for determining, for displaying the total amount of said coins; and means for dispensing a voucher from said kiosk redeemable in cash or merchandise for a value related to said total amount.

41. An apparatus for allowing an untrained user to obtain a voucher for coins comprising:

a tray for receiving; a plurality of coins of arbitrary denomination from said untrained user, said tray having openings in its bottom for allowing waste to fall through, said tray being moveable to move said coins to an output end thereof such that some waste is separated from said coins through said openings as said coins move to said output end as said tray is moved;

means, separate from said tray, for removing additional waste included among said coins;

means, coupled to said means from removing for determining a total amount of said coins; and means, coupled to said means for determining, for dispensing a voucher redeemable in cash or merchandise for a value related to said total amount.

* * * * *